US005735713A

United States Patent [19]

Sugiura

[11] Patent Number: 5,735,713

[45] Date of Patent: Apr. 7, 1998

[54] ELECTRICAL JUNCTION BOX

[75] Inventor: Tomohiro Sugiura, Shizuoka, Japan

[73] Assignee: Yazaki Corporation, Tokyo, Japan

[21] Appl. No.: 748,497

[22] Filed: Nov. 8, 1996

[30] Foreign Application Priority Data

Nov. 8, 1995 [JP] Japan ..... 7-289869

[51] Int. Cl.[6] ..... H01R 25/00

[52] U.S. Cl. ..... 439/638; 439/949

[58] Field of Search ..... 439/76.2, 212, 439/949, 638, 651, 639

[56] References Cited

U.S. PATENT DOCUMENTS 4,429,943 2/1984 Inoue ..... 439/949
4,747,791 5/1988 Nishio ..... 439/638
4,923,411 5/1990 Hayashi et al. ..... 439/638

FOREIGN PATENT DOCUMENTS 6-80318 11/1994 Japan .

*Primary Examiner*—Neil Abrams
*Assistant Examiner*—Barry M. L. Standig
*Attorney, Agent, or Firm*—Sughrue, Mion, Zinn, Macpeak & Seas, PLLC

[57] ABSTRACT

An electrical junction box includes a cover body having a plurality of cavities with which a plurality of electrical components are engaged; and rear covers which are separately provided for each of sub wire harnesses W1 and W2, and are fixedly combined with the cover body. With the electrical junction box of the invention, connection of power lines is achieved with a general connector, and the connector is connected to a housing which is provided on any one of the rear covers.

3 Claims, 5 Drawing Sheets

ELECTRICAL JUNCTION BOX

BACKGROUND OF THE INVENTION

This invention relates to electrical junction boxes which are used for connection of wire harnesses, and more particularly to an electrical junction box which simplifies the connection of power source wires, and is assembled with high work efficiency.

A variety of electrical junction boxes are used for electrical systems such as those in automobiles and are well known in the art. A conventional electrical junction box will be described, by way of example, with reference to that which has been disclosed by Japanese Utility Model Unexamined Publication No. Hei 6-80318.

As shown in FIG. 4, the electrical junction box 51 comprises: a cover body 56 of insulating synthetic resin; and rear covers 57, 58 and 59 which are provided for sub wire harnesses W1, W2 and W3, respectively.

The cover body 56 has fuse cavities 52, relay cavities 53, a female connector housing 54, and a fusible link cavity 55 on its surface which are coupled to a plurality of electrical components such as fuses and relays.

The rear covers 57, 58 and 59 are fixedly combined with the cover body 56 with conventional means such as screws. Those covers 57, 58 and 59 are provided for the sub wire harnesses W1, W2 and W3, respectively, which are divided according to their destinations such as head-lamps, an engine room, meters in an instrument panel, a console box, and doors, or according to load systems such as electrical devices.

For power distribution, upstream power lines together with fusible links (not shown) are connected through existing LA terminals or the like to the aforementioned fusible link cavity 55 with bolts. For supply of power to circuits which are free from the fusible link cavity 55, connectors provided for the sub wire harnesses are employed.

In more detail, as shown in FIG. 5, the rear covers 57 and 58 have housing portions 60, to which male terminals 62 are inserted which are fixedly secured to the end portions of the wires 61 of the sub wire harnesses W1, W2 and W3.

On the other hand, in the electrical junction box 51, L-shaped bus bars 63 and 64 form internal circuits for the sub wire harnesses W1 and W2. Furthermore, on the inner surface of the top wall 56A of the cover body 56, a supporting wall 66 having a bus bar holding groove 65 is formed. And the supporting wall 66 has terminal accommodating chambers 71, 72, 73 and 74 in correspondence to relay terminals 67, 68, 69 and 70 at the ends and in the middle. Also, relay terminals 75 and 76 are engaged with terminal accommodating chambers 77 and 78 formed on the top wall 56A of the cover body 56 and with the male terminals 62 fixedly secured to the ends of wires 61.

In the above-described electrical junction box 51, the rear covers 57 and 58 are separately combined with the cover body 56. That is, in the rear covers 57 and 58, the male terminals 62 fixedly secured to the ends of the wires 61 forming the sub wire harness W1 are engaged with the housing portions 60 from behind at predetermined positions.

In the cover body 56, the bus bars 63 and 64 are press-fitted in the bus bar holding grooves 65, and thereafter the relay terminals 67, 68, 69, 70, 75 and 76 are inserted into the terminal accommodating chambers 71, 72, 73, 74, 77 and 78, respectively. As a result, the relay terminals 67, 68, 69, 70, 75 and 76 are conductively connected with the respective bus bars 63 and 64.

Next, the rear covers 67 and 68 are fixedly combined with the cover body 56 one by one, and relays and fuses are inserted into the relay cavities 53 and the fuse cavities 52. Finally, for power distribution, the fusible links (not shown) together with the LA terminals of the upstream power lines are tightened to the fusible link cavity 55 with bolts. Thus, the desired electrical junction box 51 is manufactured and the sub wire harnesses W1, W2 and W3 are connected.

In the above-described electrical junction box 51, the connection of the wire harness thereto is achieved separately according to the sub wire harnesses, which simplifies the internal circuit arrangement, and makes it easy to form a desired circuit and to change a circuit specification.

However, the above-described electrical junction box suffers from the following difficulties: for the supply of power to the circuits in joint boxes which is not through the bolt-tightened fusible links, that is, as for the supply of power to the rear covers 57, 58 and 59, the number of poles of the upstream power lines is small, and the power lines are relatively large in diameter. Hence, it is necessary to additionally provide connectors for the sub wire harnesses, with a result that the electrical junction box is high in manufacturing cost.

Further, when the wiring is achieved by arranging stripe-shaped bus bars, the method gives rise to another problems; that is, the space available makes it difficult to design the desired circuit, and to arrange the bus bars.

SUMMARY OF THE INVENTION

In view of the foregoing, an object of the invention is to provide an electrical junction box in which upstream power lines can be readily led to a rear cover combined with a cover body, and which can be designed and manufactured with ease, thus being low in manufacturing cost.

The foregoing object of the invention has been achieved by the provision of an electrical junction box comprising: a cover body having a plurality of cavities with which a plurality of electrical components are engaged; and rear covers which are separately provided for sub wire harnesses, and are fixedly combined with the cover body, in which connection of power lines is achieved with a general connector, and the connector is connected to a housing which is provided on any one of the rear covers.

In the electrical junction box, the housing is provided on one of the rear covers in such a manner that the housing is integral therewith, and is detachably connected to the rear cover.

With the electrical junction box of the invention, it is unnecessary to additionally provide sub wire harness split connectors for the power lines with respect to the rear covers. This feature reduces the manufacturing cost of the electrical junction box. Furthermore, the power lines can be handled in the assembly line of the manufacturer, which facilitates the manufacturing of the electrical junction box. In addition, the connection of the power lines is accomplished merely by connecting the connector to the housing provided on the rear cover, which improves the work efficiency.

DETAILED DESCRIPTION OF THE INVENTION

Figure 1:
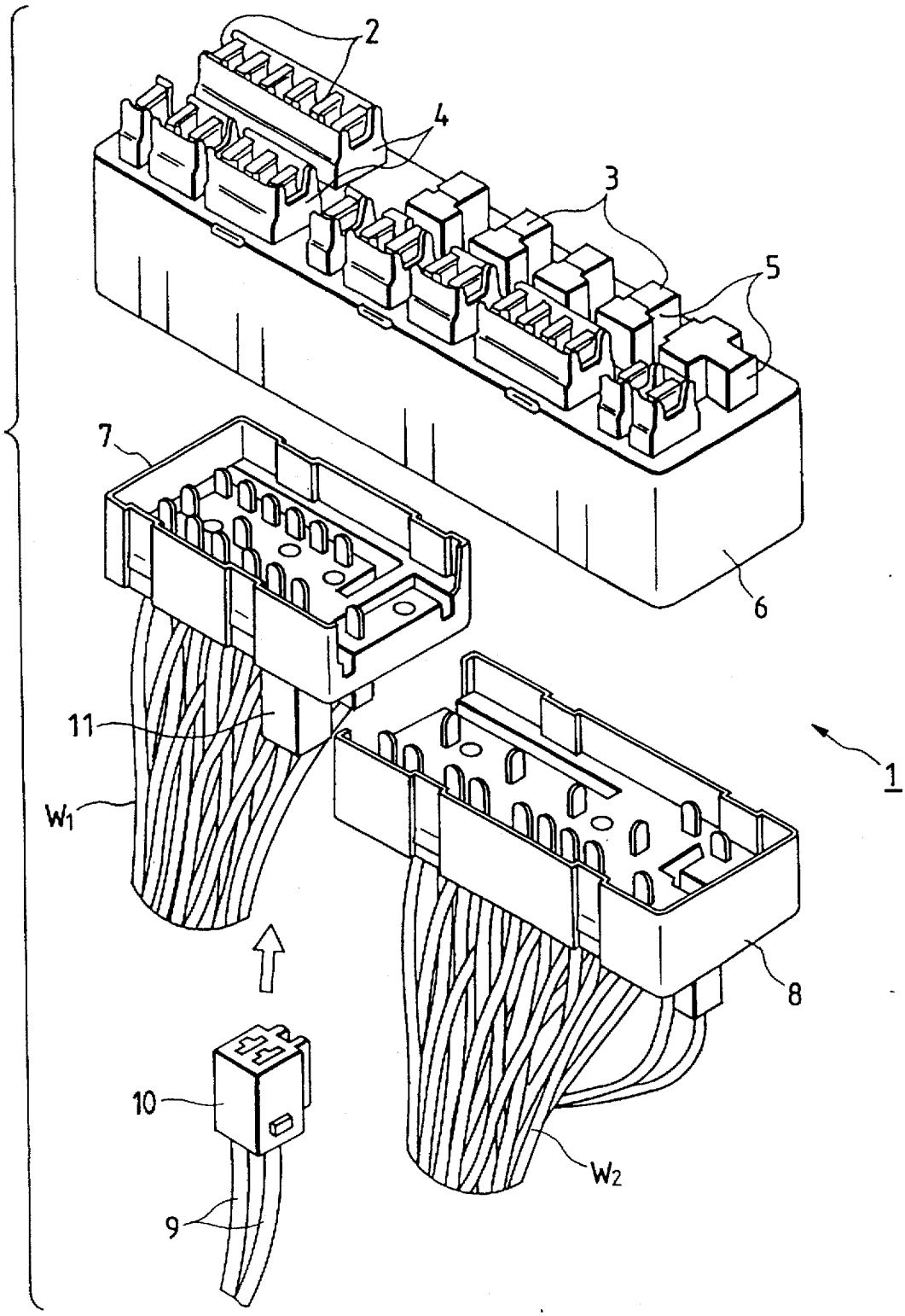
FIG. 1 is an exploded perspective view of an electrical junction box, which constitutes a preferred embodiment of the invention.
Figure 2:
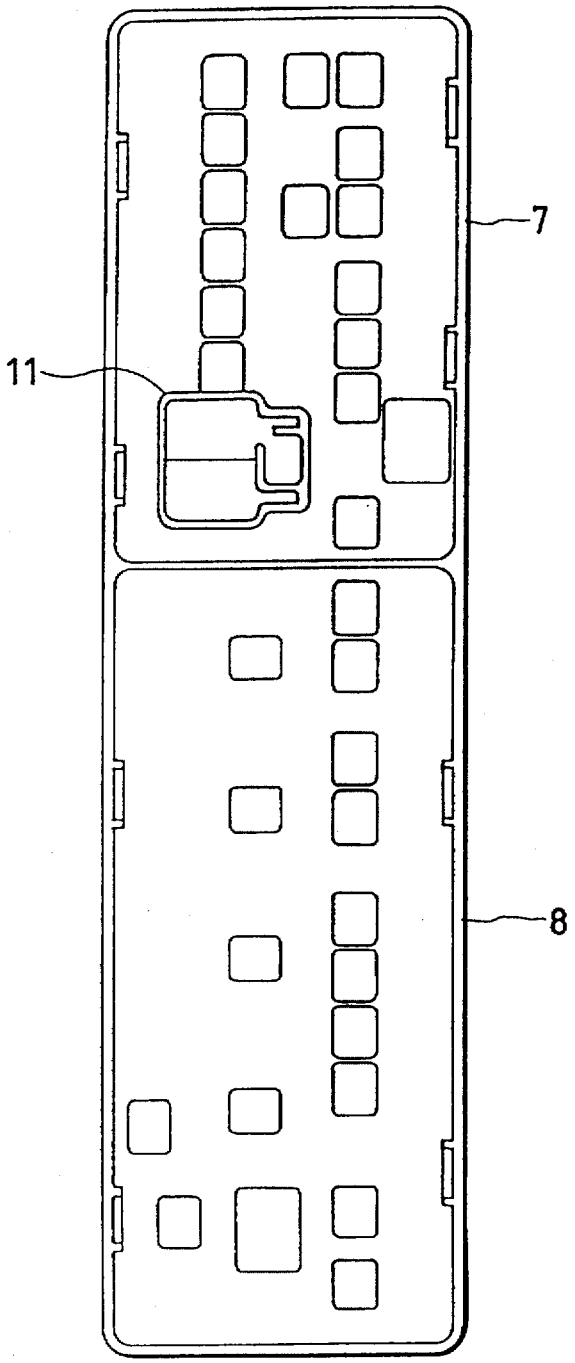
FIG. 2 is a bottom view showing the assembled electrical junction box except sub wire harnesses and a power connector.
Figure 3:
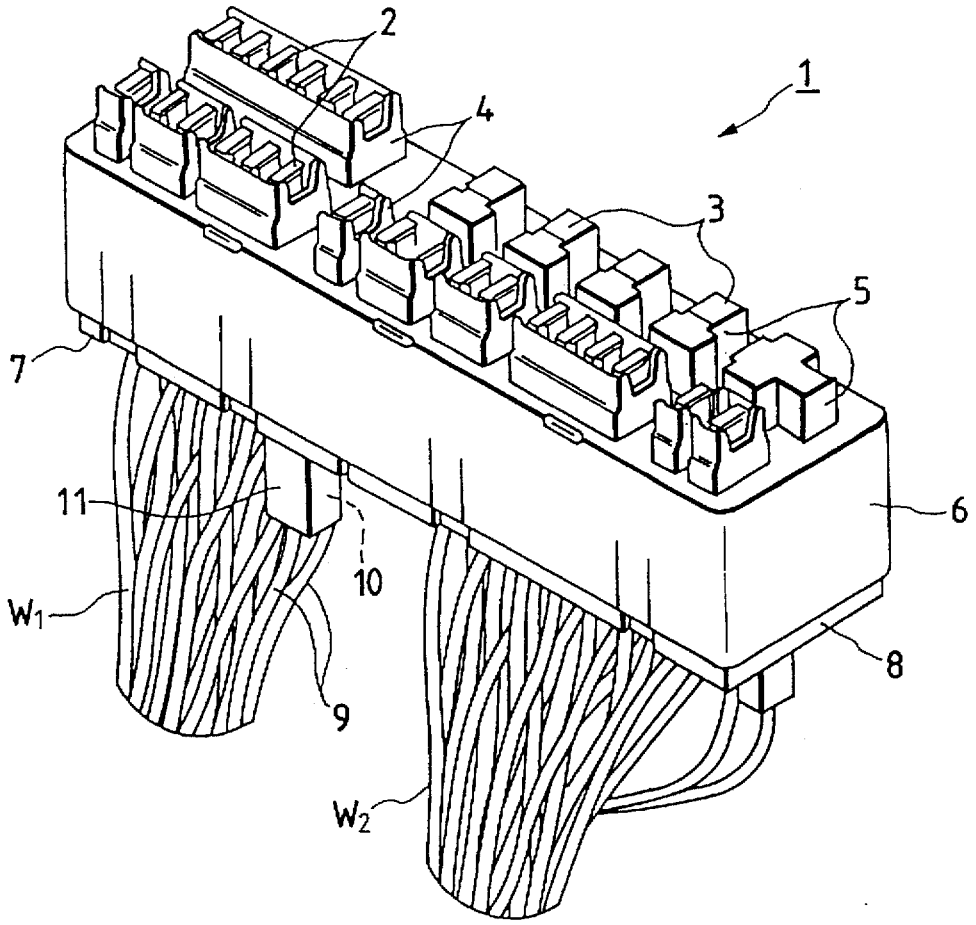
FIG. 3 is a perspective view showing the electrical junction box which has been assembled.
Figure 4:
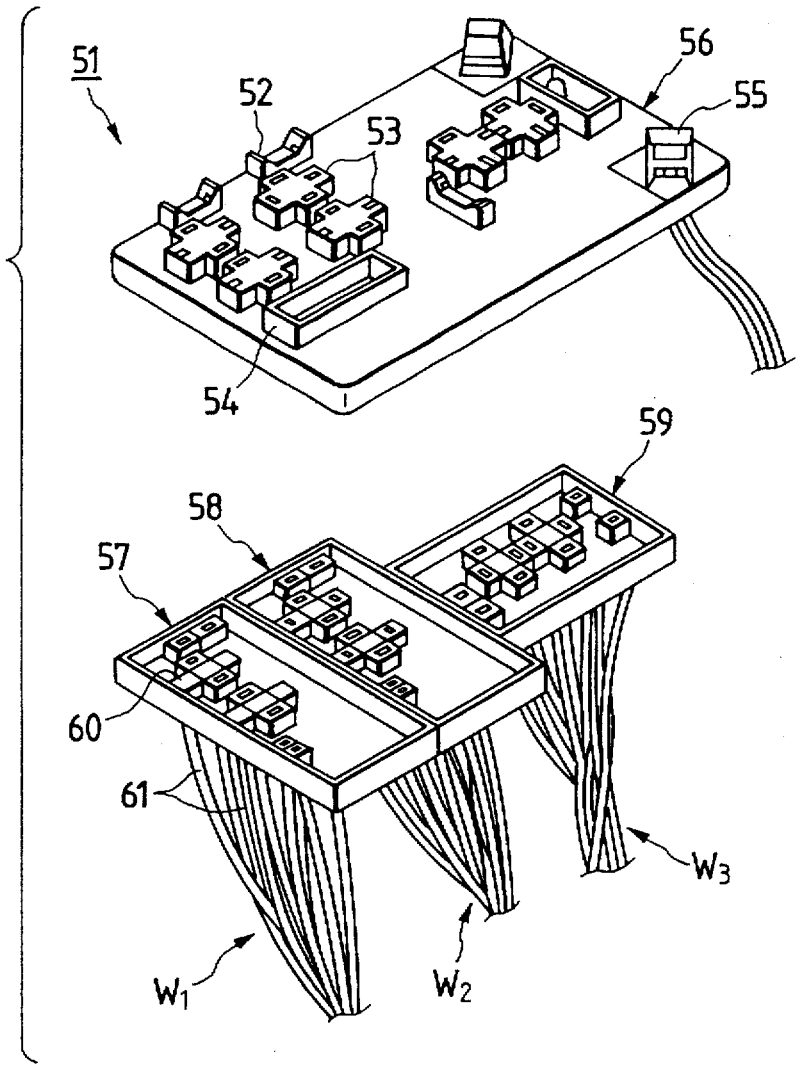
FIG. 4 PRIOR ART
FIG. 4 is an exploded perspective view of a conventional electrical junction box.
Figure 5:
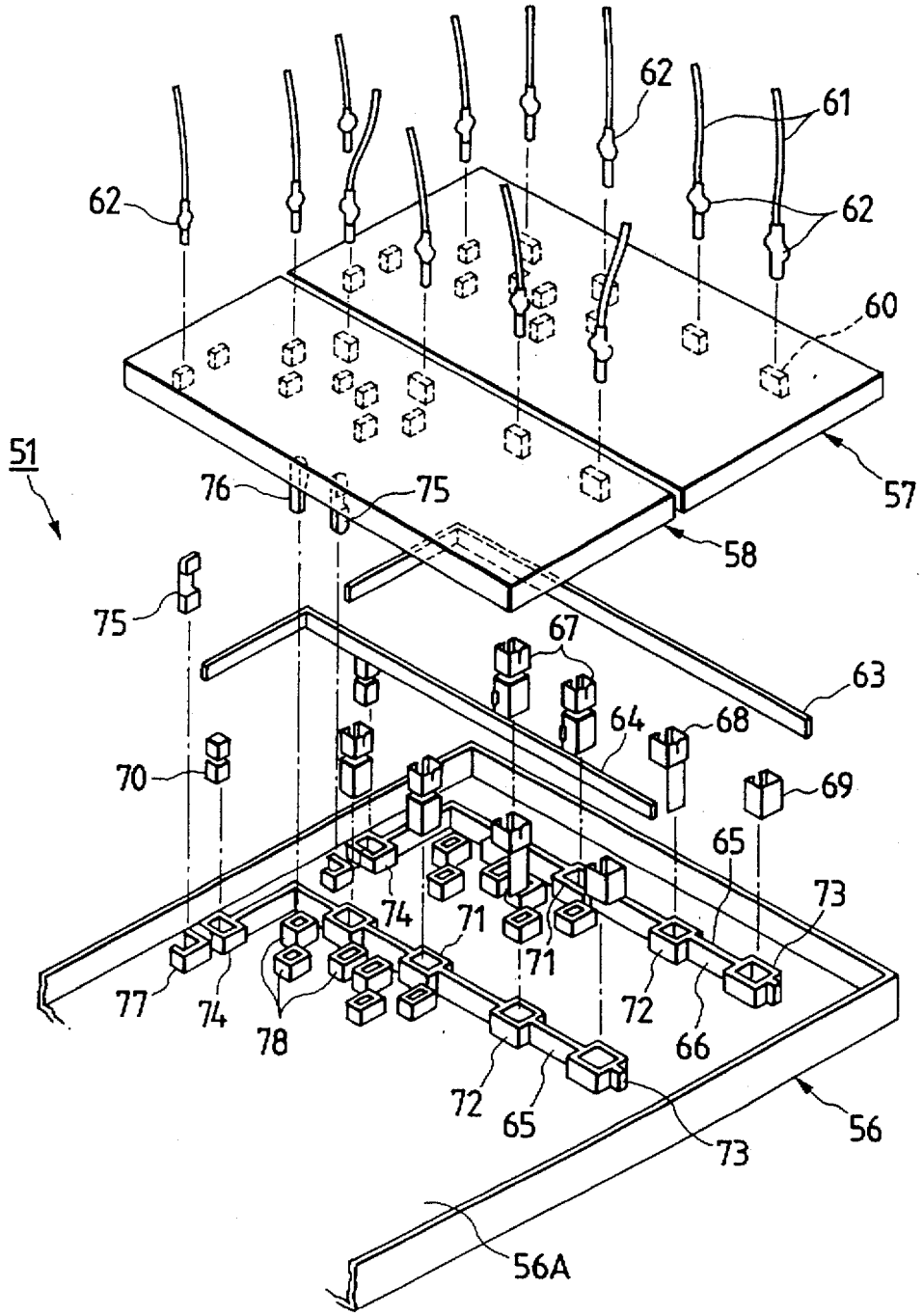
FIG. 5 PRIOR ART
FIG. 5 is an exploded perspective view showing essential components of the conventional electrical junction box.

An electrical junction box, which constitutes a preferred embodiment of the invention, will be described with reference to FIGS. 1 through 3. FIG. 1 is an exploded perspective view of the electrical junction box, the embodiment of the invention. FIG. 2 is a bottom view showing the assembled electrical junction box except sub wire harnesses and power connectors, and FIG. 3 is a perspective view of the assembly of various components shown in FIG. 1.

As shown in FIG. 1, the electrical junction box 1 of the invention comprises: a cover body 6 of synthetic resin on the outer surface of which fuse cavities 4 and relay cavities 5 are formed, with which electrical components such as fuses 2 and relays 3 are engaged, respectively. The electrical junction box 1 further comprises: rear covers 7 and 8 which are provided separately in correspondence to sub wire harnesses W1 and W2, and which are secured to the cover body 6 with conventional means such as screws. The sub wire harnesses W1 and W2 are divided separately according to their destinations such as head-lamps, an engine room, meters in an instrument panel, a console box, and doors, or according to load systems such as electrical devices.

Connection of power lines 9 to the electrical junction box is achieved by connecting a general power connector 10 to a housing 11, which is formed on the bottom of the rear cover 7. The housing 11 is so formed that it becomes integral with the rear cover, and further it is detachably combined with the rear cover 7.

In the electrical junction box thus constructed, the rear covers 7 and 8 are combined with the cover body 6 one after another. That is, the rear covers 7 and 8 are fixedly engaged with the cover body 6 one after another, and thereafter the relays 3 and the fuses 2 are engaged with the relay cavities 5 and the fuse cavities 4, respectively, so that the connection of the sub wire harnesses W1 and W2 is accomplished. Thereafter, the power connector 10 is engaged with the housing 11 provided on the bottom of the rear cover 7; that is, the connection of the power lines is accomplished. Thus, the electrical junction box 1 is assembled.

The electrical junction box 1 thus designed is advantageous as follows: With respect to the rear covers 7 and 8 having no bolt-tightened fusible links, it is unnecessary to additionally provide the sub wire harness split connectors for the power lines. This feature reduces the manufacturing cost of the electrical junction box.

Furthermore, in the wire harness manufacturing line, the power lines can be handled in the assembly line of the manufacturer, which facilitates the manufacturing of the electrical junction box. In addition, the connection of the power lines is accomplished merely by connecting the connector 10 to the housing 11 provided on the rear cover 7, which improves the work efficiency as much.

While there has been described a preferred embodiment of the invention, it will be obvious to those skilled in the art that various changes and modifications may be made therein without departing from the invention. For instance, in the above-described embodiment, the electrical components such as the fuses 2 and the relays 3 are mounted on the cover body 6; however, the invention is not limited thereto or thereby. That is, other electrical devices such as timers and counters may be mounted on the cover body 6.

As was described above, with the electrical junction box of the invention, connection of the power lines thereto is achieved with a general connector, and the general connector is engaged with the housing formed on one of the above-described rear covers.

Hence, it is unnecessary to additionally provide a power connector on each of the rear covers, which reduces the manufacturing cost.

In addition, the connection of the power lines can be achieved even on the assembly line, and therefore the electrical junction box can be assembled with ease. Furthermore, as was described above, the connection of the power lines can be achieved merely by inserting the connector to the housing formed on the rear cover, with a result that the electrical junction box improves work efficiency.

What is claimed is:

1. An electrical junction box, comprising:

a cover body having a plurality of cavities engageable with a plurality of electrical components;

a plurality of rear covers, each of said rear covers corresponding to a respective sub wire harness, and fixedly engageable with said cover body; and a housing disposed on any one of said rear covers, said housing being engageable with a general connector for connection of power lines;

wherein power is connected to all of said rear covers and said cover body through said housing.

2. An electrical junction box as claimed in claim 1, wherein said housing is disposed on one of said rear covers and said housing is integral therewith.

3. An electrical junction box as claimed in claim 1, wherein said housing is detachably connected to one of said rear covers.

* * * * *